US008151482B2

(12) United States Patent
Moss et al.

(10) Patent No.: US 8,151,482 B2
(45) Date of Patent: Apr. 10, 2012

(54) TWO-STAGE STATIC DRYER FOR CONVERTING ORGANIC WASTE TO SOLID FUEL

(76) Inventors: William H Moss, Coral Springs, FL (US); Richard J Romanek, Jr., New Port Richey, FL (US)

( * ) Notice: Subject to any disclaimer, the term of this patent is extended or adjusted under 35 U.S.C. 154(b) by 655 days.

(21) Appl. No.: 12/313,737

(22) Filed: Nov. 25, 2008

(65) Prior Publication Data

US 2010/0126037 A1 May 27, 2010

(51) Int. Cl.
*F26B 11/03* (2006.01)

(52) U.S. Cl. ..... 34/471; 34/381; 34/497; 159/4.02; 159/16.1; 210/609

(58) Field of Classification Search ..... 34/471, 34/381, 497, 413, 90, 138, 201, 60; 159/4.02, 159/16.1; 210/609
See application file for complete search history.

(56) References Cited

U.S. PATENT DOCUMENTS 3,290,788 A * 12/1966 Seelandt ..... 34/294
3,920,505 A * 11/1975 Helleur ..... 159/47.3
4,047,489 A 9/1977 Voorheis et al.
4,079,585 A * 3/1978 Helleur ..... 60/781
4,114,289 A 9/1978 Boulet
4,171,384 A 10/1979 Chwalek et al.
4,181,748 A 1/1980 Chwalek et al.
4,258,476 A 3/1981 Caughey
4,424,634 A 1/1984 Westelaken
4,873,110 A 10/1989 Short et al.
4,987,252 A * 1/1991 Kuragano et al. ..... 562/600
5,161,315 A 11/1992 Long
5,207,734 A * 5/1993 Day et al. ..... 60/278
5,233,766 A 8/1993 Frederiksen et al.
5,238,399 A 8/1993 Long
5,265,347 A 11/1993 Woodson et al.
5,476,990 A * 12/1995 Hittner et al. ..... 588/314
5,546,673 A 8/1996 Weagraff et al.
5,611,150 A 3/1997 Yore, Jr.
5,616,296 A * 4/1997 Hittner et al. ..... 266/145
5,711,018 A * 1/1998 Hittner et al. ..... 588/314
5,843,307 A * 12/1998 Faivre et al. ..... 210/192
5,852,882 A 12/1998 Kendall et al.
6,082,251 A 7/2000 Kendall et al.
6,125,550 A 10/2000 Kendall et al.
6,168,815 B1 1/2001 Kossmann et al.
6,184,373 B1 * 2/2001 Bernard et al. ..... 536/58
6,237,244 B1 5/2001 Bryan et al.
6,311,411 B1 11/2001 Clark
6,332,909 B1 * 12/2001 Teshima et al. ..... 75/401
6,438,864 B1 8/2002 Sandford
6,467,188 B1 10/2002 Sandford (Continued)

FOREIGN PATENT DOCUMENTS

DE 3904262 A1 * 8/1990

(Continued)

*Primary Examiner* — Stephen M. Gravini

(57) ABSTRACT

An energy-efficient method and apparatus for drying pelletized, moist organic material is described. The method consists of a rapid, high temperature static drying process in a shallow bed, followed by traditional vertical static drying in a deep bed. Hot exhaust gas from the shallow-bed, hot-temperature static dryer is then recirculated to provide thermal energy to the deep-bed, warn-temperature static dryer. This invention can be used to convert wet, organic waste materials such as animal and poultry waste, municipal wastewater sludge, urban post-consumer food waste, or manufactured food byproducts and residuals into solid fuel.

4 Claims, 1 Drawing Sheet

U.S. PATENT DOCUMENTS

| | | | | |
|---|---|---|---|---|
| 6,505,416 | B2 | 1/2003 | Sandford | |
| 6,635,297 | B2 | 10/2003 | Moss et al. | |
| 6,692,642 | B2 | 2/2004 | Josse et al. | |
| 6,719,821 | B2 * | 4/2004 | Yadav et al. | 75/343 |
| 6,782,947 | B2 * | 8/2004 | de Rouffignac et al. | 166/245 |
| 6,807,748 | B2 | 10/2004 | Bryan et al. | |
| 6,807,749 | B2 | 10/2004 | Norman et al. | |
| 6,877,555 | B2 * | 4/2005 | Karanikas et al. | 166/245 |
| 6,880,633 | B2 * | 4/2005 | Wellington et al. | 166/245 |
| 6,915,850 | B2 * | 7/2005 | Vinegar et al. | 166/272.2 |
| 6,918,442 | B2 * | 7/2005 | Wellington et al. | 166/245 |
| 6,918,443 | B2 * | 7/2005 | Wellington et al. | 166/245 |
| 6,923,257 | B2 * | 8/2005 | Wellington et al. | 166/245 |
| 6,929,067 | B2 * | 8/2005 | Vinegar et al. | 166/302 |
| 6,932,155 | B2 * | 8/2005 | Vinegar et al. | 166/245 |
| 6,938,357 | B2 | 9/2005 | Hauch | |
| 6,948,562 | B2 * | 9/2005 | Wellington et al. | 166/272.1 |
| 6,951,247 | B2 * | 10/2005 | de Rouffignac et al. | 166/245 |
| 6,964,300 | B2 * | 11/2005 | Vinegar et al. | 166/245 |
| 6,966,374 | B2 * | 11/2005 | Vinegar et al. | 166/272.3 |
| 6,969,123 | B2 * | 11/2005 | Vinegar et al. | 299/3 |
| 6,981,548 | B2 * | 1/2006 | Wellington et al. | 166/245 |
| 6,991,032 | B2 * | 1/2006 | Berchenko et al. | 166/245 |
| 6,991,033 | B2 * | 1/2006 | Wellington et al. | 166/245 |
| 6,991,036 | B2 * | 1/2006 | Sumnu-Dindoruk et al. | 166/302 |
| 6,991,045 | B2 * | 1/2006 | Vinegar et al. | 175/45 |
| 6,994,169 | B2 * | 2/2006 | Zhang et al. | 166/302 |
| 6,997,518 | B2 * | 2/2006 | Vinegar et al. | 299/5 |
| 7,004,247 | B2 * | 2/2006 | Cole et al. | 166/60 |
| 7,004,251 | B2 * | 2/2006 | Ward et al. | 166/245 |
| 7,011,154 | B2 * | 3/2006 | Maher et al. | 166/245 |
| 7,013,972 | B2 * | 3/2006 | Vinegar et al. | 166/257 |
| 7,024,794 | B1 | 4/2006 | Mynes | |
| 7,032,660 | B2 * | 4/2006 | Vinegar et al. | 166/245 |
| 7,040,397 | B2 * | 5/2006 | de Rouffignac et al. | 166/245 |
| 7,040,398 | B2 * | 5/2006 | Wellington et al. | 166/245 |
| 7,040,399 | B2 * | 5/2006 | Wellington et al. | 166/245 |
| 7,040,400 | B2 * | 5/2006 | de Rouffignac et al. | 166/245 |
| 7,051,807 | B2 * | 5/2006 | Vinegar et al. | 166/245 |
| 7,051,808 | B1 * | 5/2006 | Vinegar et al. | 166/250.1 |
| 7,051,811 | B2 * | 5/2006 | de Rouffignac et al. | 166/302 |
| 7,055,600 | B2 * | 6/2006 | Messier et al. | 166/250.01 |
| 7,063,145 | B2 * | 6/2006 | Veenstra et al. | 166/250.01 |
| 7,066,254 | B2 * | 6/2006 | Vinegar et al. | 166/245 |
| 7,066,257 | B2 * | 6/2006 | Wellington et al. | 166/272.2 |
| 7,077,198 | B2 * | 7/2006 | Vinegar et al. | 166/245 |
| 7,077,199 | B2 * | 7/2006 | Vinegar et al. | 166/250.01 |
| 7,086,465 | B2 * | 8/2006 | Wellington et al. | 166/272.1 |
| 7,090,013 | B2 * | 8/2006 | Wellington | 166/267 |
| 7,096,942 | B1 * | 8/2006 | de Rouffignac et al. | 166/245 |
| 7,100,994 | B2 * | 9/2006 | Vinegar et al. | 299/7 |
| 7,104,319 | B2 * | 9/2006 | Vinegar et al. | 166/245 |
| 7,114,566 | B2 * | 10/2006 | Vinegar et al. | 166/256 |
| 7,128,153 | B2 * | 10/2006 | Vinegar et al. | 166/285 |
| 7,152,616 | B2 * | 12/2006 | Zucchelli et al. | 137/68.11 |
| 7,156,176 | B2 * | 1/2007 | Vinegar et al. | 166/302 |
| 7,165,615 | B2 * | 1/2007 | Vinegar et al. | 166/302 |
| 7,171,762 | B2 | 2/2007 | Roberts et al. | |
| 7,225,866 | B2 * | 6/2007 | Berchenko et al. | 166/245 |
| 7,378,070 | B2 * | 5/2008 | Megy | 423/304 |
| 7,413,760 | B2 | 8/2008 | Green et al. | |
| 7,421,802 | B2 | 9/2008 | Roberts et al. | |
| 7,461,691 | B2 * | 12/2008 | Vinegar et al. | 166/60 |
| 7,640,766 | B2 * | 1/2010 | Shelton | 62/389 |
| 7,735,274 | B2 * | 6/2010 | Constantz et al. | 52/294 |
| 7,735,935 | B2 * | 6/2010 | Vinegar et al. | 299/5 |
| 7,744,761 | B2 * | 6/2010 | Constantz et al. | 210/652 |
| 7,749,476 | B2 * | 7/2010 | Constantz et al. | 423/430 |
| 7,753,618 | B2 * | 7/2010 | Constantz et al. | 404/44 |
| 7,754,169 | B2 * | 7/2010 | Constantz et al. | 423/165 |
| 7,771,684 | B2 * | 8/2010 | Constantz et al. | 423/220 |
| 7,815,880 | B2 * | 10/2010 | Constantz et al. | 423/220 |
| 7,829,053 | B2 * | 11/2010 | Constantz et al. | 423/430 |
| 7,866,638 | B2 * | 1/2011 | Neumann et al. | 261/115 |
| 7,887,694 | B2 * | 2/2011 | Constantz et al. | 205/480 |
| 7,902,262 | B2 * | 3/2011 | Armstrong et al. | 521/40 |
| 7,906,028 | B2 * | 3/2011 | Constantz et al. | 210/702 |
| 7,910,080 | B2 * | 3/2011 | Megy | 423/304 |
| 7,914,685 | B2 * | 3/2011 | Constantz et al. | 210/702 |
| 7,931,809 | B2 * | 4/2011 | Constantz et al. | 210/652 |
| 2002/0178865 | A1 * | 12/2002 | Yadav et al. | 75/330 |
| 2003/0071069 | A1 * | 4/2003 | Shelton | 222/190 |
| 2003/0079877 | A1 * | 5/2003 | Wellington et al. | 166/272.1 |
| 2003/0080604 | A1 * | 5/2003 | Vinegar et al. | 299/14 |
| 2003/0098149 | A1 * | 5/2003 | Wellington et al. | 166/52 |
| 2003/0098605 | A1 * | 5/2003 | Vinegar et al. | 299/14 |
| 2003/0100451 | A1 * | 5/2003 | Messier et al. | 507/100 |
| 2003/0102124 | A1 * | 6/2003 | Vinegar et al. | 166/256 |
| 2003/0102125 | A1 * | 6/2003 | Wellington et al. | 166/266 |
| 2003/0102126 | A1 * | 6/2003 | Sumnu-Dindoruk et al. | 166/272.1 |
| 2003/0102130 | A1 * | 6/2003 | Vinegar et al. | 166/302 |
| 2003/0108460 | A1 * | 6/2003 | Andreev et al. | 422/186.07 |
| 2003/0111223 | A1 * | 6/2003 | Rouffignac et al. | 166/256 |
| 2003/0116315 | A1 * | 6/2003 | Wellington et al. | 166/256 |
| 2003/0130136 | A1 * | 7/2003 | Rouffignac et al. | 507/200 |
| 2003/0131993 | A1 * | 7/2003 | Zhang et al. | 166/256 |
| 2003/0131994 | A1 * | 7/2003 | Vinegar et al. | 166/256 |
| 2003/0131995 | A1 * | 7/2003 | de Rouffignac et al. | 166/272.1 |
| 2003/0131996 | A1 * | 7/2003 | Vinegar et al. | 166/272.1 |
| 2003/0136558 | A1 * | 7/2003 | Wellington et al. | 166/245 |
| 2003/0136559 | A1 * | 7/2003 | Wellington et al. | 166/250.01 |
| 2003/0137181 | A1 * | 7/2003 | Wellington et al. | 299/5 |
| 2003/0141066 | A1 * | 7/2003 | Karanikas et al. | 166/302 |
| 2003/0141067 | A1 * | 7/2003 | Rouffignac et al. | 166/302 |
| 2003/0141068 | A1 * | 7/2003 | Pierre de Rouffignac et al. | 166/302 |
| 2003/0142964 | A1 * | 7/2003 | Wellington et al. | 392/301 |
| 2003/0146002 | A1 * | 8/2003 | Vinegar et al. | 166/384 |
| 2003/0148894 | A1 * | 8/2003 | Vinegar et al. | 507/200 |
| 2003/0155111 | A1 * | 8/2003 | Vinegar et al. | 166/59 |
| 2003/0164239 | A1 * | 9/2003 | Wellington et al. | 166/302 |
| 2003/0173072 | A1 * | 9/2003 | Vinegar et al. | 166/66.5 |
| 2003/0173078 | A1 * | 9/2003 | Wellington et al. | 166/250.07 |
| 2003/0173080 | A1 * | 9/2003 | Berchenko et al. | 166/256 |
| 2003/0173081 | A1 * | 9/2003 | Vinegar et al. | 166/272.1 |
| 2003/0173082 | A1 * | 9/2003 | Vinegar et al. | 166/272.2 |
| 2003/0173085 | A1 * | 9/2003 | Vinegar et al. | 166/302 |
| 2003/0178191 | A1 * | 9/2003 | Maher et al. | 166/65.1 |
| 2003/0183390 | A1 * | 10/2003 | Veenstra et al. | 166/302 |
| 2003/0192691 | A1 * | 10/2003 | Vinegar et al. | 166/250.12 |
| 2003/0192693 | A1 * | 10/2003 | Wellington | 166/267 |
| 2003/0196788 | A1 * | 10/2003 | Vinegar et al. | 166/57 |
| 2003/0196789 | A1 * | 10/2003 | Wellington et al. | 166/64 |
| 2003/0196801 | A1 * | 10/2003 | Vinegar et al. | 166/263 |
| 2003/0196810 | A1 * | 10/2003 | Vinegar et al. | 166/300 |
| 2003/0201098 | A1 * | 10/2003 | Karanikas et al. | 166/53 |
| 2003/0205378 | A1 * | 11/2003 | Wellington et al. | 166/302 |
| 2003/0209348 | A1 * | 11/2003 | Ward et al. | 166/256 |
| 2004/0020642 | A1 * | 2/2004 | Vinegar et al. | 166/245 |
| 2004/0040715 | A1 * | 3/2004 | Wellington et al. | 166/302 |
| 2004/0055969 | A1 * | 3/2004 | Barnes | 210/760 |
| 2004/0074252 | A1 * | 4/2004 | Shelton | 62/318 |
| 2004/0139821 | A1 * | 7/2004 | Yadav | 75/343 |
| 2004/0211554 | A1 * | 10/2004 | Vinegar et al. | 166/60 |
| 2004/0211557 | A1 * | 10/2004 | Cole et al. | 166/242.1 |
| 2004/0211569 | A1 * | 10/2004 | Vinegar et al. | 166/380 |
| 2005/0056313 | A1 * | 3/2005 | Hagen et al. | 137/3 |
| 2005/0092483 | A1 * | 5/2005 | Vinegar et al. | 166/60 |
| 2005/0109396 | A1 * | 5/2005 | Zucchelli et al. | 137/67 |
| 2006/0083694 | A1 * | 4/2006 | Kodas et al. | 424/46 |
| 2006/0213657 | A1 * | 9/2006 | Berchenko et al. | 166/245 |
| 2007/0054106 | A1 * | 3/2007 | Armstrong et al. | 428/304.4 |
| 2007/0095393 | A1 * | 5/2007 | Zucchelli et al. | 137/68.11 |
| 2007/0160899 | A1 * | 7/2007 | Atanassova et al. | 429/44 |
| 2007/0178163 | A1 * | 8/2007 | Kodas et al. | 424/489 |
| 2007/0209799 | A1 * | 9/2007 | Vinegar et al. | 166/302 |
| 2007/0253882 | A1 * | 11/2007 | Megy | 423/304 |
| 2007/0290384 | A1 * | 12/2007 | Kodas et al. | 264/5 |
| 2008/0108122 | A1 * | 5/2008 | Paul et al. | 435/183 |
| 2008/0210089 | A1 * | 9/2008 | Tsangaris et al. | 95/90 |
| 2008/0219909 | A1 * | 9/2008 | Megy | 423/304 |
| 2008/0289385 | A1 * | 11/2008 | Megy | 71/33 |
| 2008/0289692 | A1 * | 11/2008 | Zucchelli et al. | 137/2 |
| 2008/0314593 | A1 * | 12/2008 | Vinegar et al. | 166/302 |
| 2009/0001020 | A1 * | 1/2009 | Constantz et al. | 210/652 |
| 2009/0020044 | A1 * | 1/2009 | Constantz et al. | 106/738 |

2009/0039000 A1* 2/2009 Zucchelli et al. ..... 210/91
2009/0165380 A1* 7/2009 Lau et al. ..... 48/127.7
2009/0169452 A1* 7/2009 Constantz et al. ..... 423/230
2010/0011956 A1* 1/2010 Neumann et al. ..... 95/151
2010/0083880 A1* 4/2010 Constantz et al. ..... 106/801
2010/0126037 A1* 5/2010 Moss et al. ..... 34/471
2010/0126727 A1* 5/2010 Vinegar et al. ..... 166/302
2010/0132556 A1* 6/2010 Constantz et al. ..... 95/234
2010/0132591 A1* 6/2010 Constantz et al. ..... 106/705
2010/0135865 A1* 6/2010 Constantz et al. ..... 422/170
2010/0135882 A1* 6/2010 Constantz et al. ..... 423/234
2010/0154679 A1* 6/2010 Constantz et al. ..... 106/638
2010/0158786 A1* 6/2010 Constantz et al. ..... 423/430
2010/0229725 A1* 9/2010 Farsad et al. ..... 96/74
2010/0230830 A1* 9/2010 Farsad et al. ..... 261/20
2010/0236242 A1* 9/2010 Farsad et al. ..... 60/685
2010/0270015 A1* 10/2010 Vinegar et al. ..... 166/272.1
2010/0275781 A1* 11/2010 Tsangaris et al. ..... 96/108
2010/0313793 A1* 12/2010 Constantz et al. ..... 106/705
2010/0319539 A1* 12/2010 Neumann et al. ..... 95/149
2010/0320294 A1* 12/2010 Neumann et al. ..... 239/556
2011/0036014 A1* 2/2011 Tsangaris et al. ..... 48/62 R
2011/0054084 A1* 3/2011 Constantz et al. ..... 524/5
2011/0059000 A1* 3/2011 Constantz et al. ..... 423/232
2011/0091366 A1* 4/2011 Kendall et al. ..... 423/220
2011/0091955 A1* 4/2011 Constantz et al. ..... 435/168

FOREIGN PATENT DOCUMENTS

DE 4445745 A1 * 8/1996
DE 10310258 A1 * 9/2004
EP 44375 A1 * 1/1982
EP 504647 A1 * 9/1992
JP 58007744 A * 1/1983
JP 63097299 A * 4/1988
JP 09066230 A * 3/1997
JP 2003227316 A * 8/2003
WO WO 9504908 A1 * 2/1995
WO WO 9810223 A1 * 3/1998

* cited by examiner

TWO-STAGE STATIC DRYER FOR CONVERTING ORGANIC WASTE TO SOLID FUEL

FIELD OF THE INVENTION

The present invention relates to the field of material drying. More particularly, the invention relates to an energy-efficient method and apparatus for drying organic waste materials such as animal and poultry waste, municipal wastewater sludge, urban post-consumer food waste, or manufactured food byproducts and residuals into solid fuel.

BACKGROUND OF THE INVENTION

Organic waste material such as such as livestock or poultry waste, municipal wastewater sludge, urban post-consumer food waste, or manufactured food byproducts has a significant quantity of combustible content. For example, dairy waste is typically 70,000 BTU/day/1,000-$lb_{mass}$ Steady State Live Weight (0.16 MJ/day/kg of live animal weight). However, this material can not be economically combusted to generate heat or power because the moisture content of the waste is too high, typically 90-95%. Mechanical dewatering can remove 50-70% of the moisture, but mechanical dewatering only reduces free water, with the resulting wet press cake having a moisture content of 55-70%. Evaporative drying is required to reduce the moisture content in organic material to less than 10% moisture. Drying the material to less than 10% moisture will suppress natural aerobic biodegradation, extending the shelf life of the material so that its will retain its heat value in storage. It is also important to reduce moisture to increase the energy content in the dried material to greater than 9,500 BTU/$lb_{mass}$ (greater than 22 MJ/kg) so that it is suitable as a substitute for fuel without degrading the combustion process that is generating steam for thermal energy or electricity. The preferred shape of the dried solid fuel is a pellet, which is suitable for a variety of standard bulk handling and material transport equipment.

An example of a process to produce pelletized, dried organic material is provided in U.S. Pat. No. 6,692,642 (Josse et al.) which describes complete biological treatment of hog manure with anaerobic stabilization, mechanical dewatering of solids, and indirect heat drying using a hot-oil disk dryer followed by pelletization for use as fertilizer. The problem with this process is that anaerobic stabilization lowers the potential fuel value of pelletized hog manure.

There are numerous examples of non-organic pellet drying. For example, U.S. Pat. Nos. 7,421,802 and 7,171,762 (Roberts et al.); U.S. Pat. No. 7,024,794 (Mynes); U.S. Pat. No. 6,938,357 (Hauch); U.S. Pat. Nos. 6,807,748 and 6,237,244 (Bryan et al.); U.S. Pat. Nos. 6,505,416, 6,467,188 and 6,438,864 (Sandford); U.S. Pat. No. 5,661,150 (Yore, Jr.); and U.S. Pat. No. 5,265,347 (Woodson et al.) are examples of centrifugal pellet dryers used in plastic manufacturing for liquid-solid plastic pellet slurry separation. These are not suitable for organic materials because the pellet strength is not high enough to hold its shape in high g-force centrifugal screening.

Another example of non-organic pellet drying is given in U.S. Pat. No. 6,807,749 (Norman et al.) wherein the use of warm, carbon black smoke is used to dry carbon black pellets. The waste heat in the carbon black smoke in the '749 patent is an example of the use of waste heat recovery of a process stream from the manufacturing process. Similar waste heat for drying of organic material is described in U.S. Pat. No. 4,114,289 (Boulet) wherein a vertical dryer with co-current gas flow and multiple chamber trays uses waste heat recovery from the exhaust gas of a bagasse-fired steam boiler as a heat source. A similar application is described in U.S. Pat. No. 4,047,489 (Voorheis et al.) wherein the process of using waste heat from a bagasse-fired boiler is used to dry wet bagasse prior to firing in the boiler. In the '489 patent, wet bagasse is dried from 50% moisture to 15-25% moisture using 610-650° F. (321-343° C.) waste heat flue gas from bagasse-fired boiler. All three of these applications have sources of waste heat available from existing, co-located manufacturing processes. A more economical method of drying is required in those instances wherein waste heat is not available from an existing process.

An example of pellet drying in the plastic industry that is more closely related to organic waste pellet drying is given in U.S. Pat. No. 5,546,763 (Weagraff et al) where warm, dehumidified air is used to dry pellets in a cylindrical, vertical dryer. The low melting point of the plastic material to be dried restricts the use of high temperature air.

This constraint on the use of high temperature is similar to the problem of drying organic waste material for use as fuel. Organic waste material such as livestock or poultry waste, municipal wastewater sludge, urban post-consumer food waste, or manufactured food byproducts needs to be dried at low temperatures—typically below 320° F. (160° C.) to prevent ignition if the intent is to dry the product for use as a solid, renewable fuel.

Fluidized bed dryers such as those described in U.S. Pat. Nos. 5,161,315 and 5,238,399 (Long) and U.S. Pat. No. 6,635,297 (Moss et al.) have been effectively used for drying and roasting of organic waste materials. The problem with low-temperature fluidized bed dryers is that the exhaust gas temperatures are typically 200-250° F. (93-121° C.). At these temperatures, the evaporation efficiency is 2,500-3,000 BTU/$lb_{mass}$ $H_2O$ removed (5.8-7.0 MJ/kg).

There are numerous examples of low-temperature drying of organic product streams. The application of low temperature drying of residuals from corn processing to produce animal feed is described in U.S. Pat. Nos. 4,181,748 and 4,171,384 (Chwalek et. al.) wherein hulls, germ cake, fine fiber tailings, and the protein-rich fraction from corn starch separation are dewatered and then dried in a convection oven at 215° F. (102° C.) for four hours (14,400 s). Another example of low temperature drying is described in U.S. Pat. No. 7,413,760 (Green et al.) in the processing of parboiled rice to make ready-to-eat cereal. The process in the '760 patent describes wet-pellet drying using warm-air drying at 122-158° F. (50-70° C.) for 20-30 minutes (1,200-1,800 seconds) to make flakes.

Vertical, static dryers with low temperatures and long residence time can be designed so that dryer exhaust gas can be saturated at temperatures as low as 15-20° F. (8.3-11.1° C.) above ambient air temperature. At these temperatures, the evaporation efficiency is 1,200-1,300 BTU/$lb_{mass}$ $H_2O$ removed (2.8-3.0 MJ/kg). Static dryers are more energy efficient and have a lower initial capital cost than other dryers with the same dryer capacity rating.

There are numerous examples of low-temperature organic pellet drying using vertical, static dryers. For example, U.S. Pat. No. 6,311,411 (Clark) used a vertical dryer with multiple decks; independent temperature and airflow control; and counter-current air flow for drying pellets made from agricultural products. U.S. Pat. No. 6,168,815 (Kossmann et al.) used low-temperature warm-air drying in vertical dryers to avoid denaturing proteins in the manufacture of fish feed directly from fresh raw fish. U.S. Pat. Nos. 6,125,550, 6,082,251, and 5,852,882 (Kendall et al.) used either a static bed or vertical dryer with non-fluidizing air flow of 100 ft/min (1.5 m/s) to lower moisture in pre-cooked, packaged rice. The final product moisture was reduced from 15-17% to 6-10% in a static bed dryer or vertical bed dryer with a residence time of 5-7 minutes (300-420 s) at 212° F. (100° C.). Another example of low-temperature drying is found in U.S. Pat. No. 5,233,766 (Frederiksen et al.) wherein a vertical dryer with a series of multiple inclined baffles are used to redirect the flow of granular material to obtain uniform residence time of grain in the manufacturing of Ready-to-Eat breakfast cereal. U.S. Pat. No. 4,424,634 (Westelaken) claims that a gravity flow vertical dryer is better than a free-fall gravity vertical dryer for drying freshly harvested grain. U.S. Pat. No. 4,258,476 (Caughey), describes a vertical dryer consisting of slow-moving gravity flow bed with low-velocity air flow of 100-500 ft/min (0.5-2.5 m/s) to dry wood chips.

A problem with static dryers is that organic waste material has a low shear stress. Static dryers are usually designed with solid bed depths of 6-12 ft (2-4 m). At these bed depths, the organic material can crush and compress, causing catastrophic failure of the dryer. U.S. Pat. No. 6,168,815 (Kossmann et al.) observed that drying pelletized, fresh raw fish to 6-10% moisture provided sufficient mechanical strength to maintain pellet shape during transport. U.S. Pat. No. 4,873,110 (Short et al.) observed that drying pelletized cereal product below 9.5% moisture resulted in the product becoming hardened. Reducing moisture to control pellet durability was also reported in U.S. Pat. No. 7,413,760 (Green et al.) for wet-pellet drying of parboiled rice cereal.

One solution is to extrude the moist organic material into pellets strands and then rapidly char the exterior of the pellet in a high temperature dryer. The outside crust of a pellet strand that has been rapidly dried at the surface can provide the rigidity to withstand the shear stress and crush pressure of a deep static bed. The charring of the pellet exterior is similar to toasting of ready-to-eat cereal flakes at high temperatures for short durations as described in U.S. Pat. No. 4,873,110 (Short et al.) and U.S. Pat. No. 7,413,760 (Green et al.).

Therefore, the object of this invention is to provide a method and apparatus that provides a rapid, high temperature static drying process in a shallow bed, followed by a traditional vertical, static dryer with a deep bed. Hot exhaust gas from a shallow-bed depth hot-temperature static dryer is then recirculated to provide thermal energy to the deep-bed warm-air static dryer.

SUMMARY OF THE INVENTION

The invention consists of a two-stage static dryer with a smaller, shallow-bed hot-temperature upper stage stacked on top of a deep-bed warm-temperature lower stage. Wet organic waste material in the form of pellet strands is fed to the upper hot-temperature stage. The solid organic material flows downward by gravity through the upper hot-temperature stage and into the lower warm-temperature stage.

In a further preferred embodiment, hot air flows counter-currently up through the static shallow bed of pellet strands in the upper hot-temperature stage. Warm air flows counter-currently up through the static deep bed of pellet strands in the lower warm-temperature stage.

In a further preferred embodiment, concave upward baffles distribute the flow of pellets evenly across the cross-section of the static dryer stages, while concave downward diffuser cones distribute the flow of hot air and warm air across the cross-section of the static dryer stages.

In a further preferred embodiment, thermal energy is added to the hot-temperature stage by heating hot air with either steam, gas, oil, electric, or waste heat. Waste heat in the upper hot-temperature stage exhaust is routed to and mixed with ambient air to provide thermal energy for the warm-air temperature stage. Additional thermal energy is added to the warm-temperature stage by heating ambient air with steam, gas, oil, electric, or waste heat.

In a further preferred embodiment, temperature controllers are provided for both stages of the two-stage static dryer. The upper hot-temperature stage controller is used to control maximum temperature to prevent ignition. The lower warm-temperature stage controller is used to control the inlet air to approximately 15-50° F. (8.3-27.8° C.) above ambient air temperature to maintain the energy efficiency of the dryer.

DESCRIPTION OF THE PREFERRED EMBODIMENTS

Figure 1:
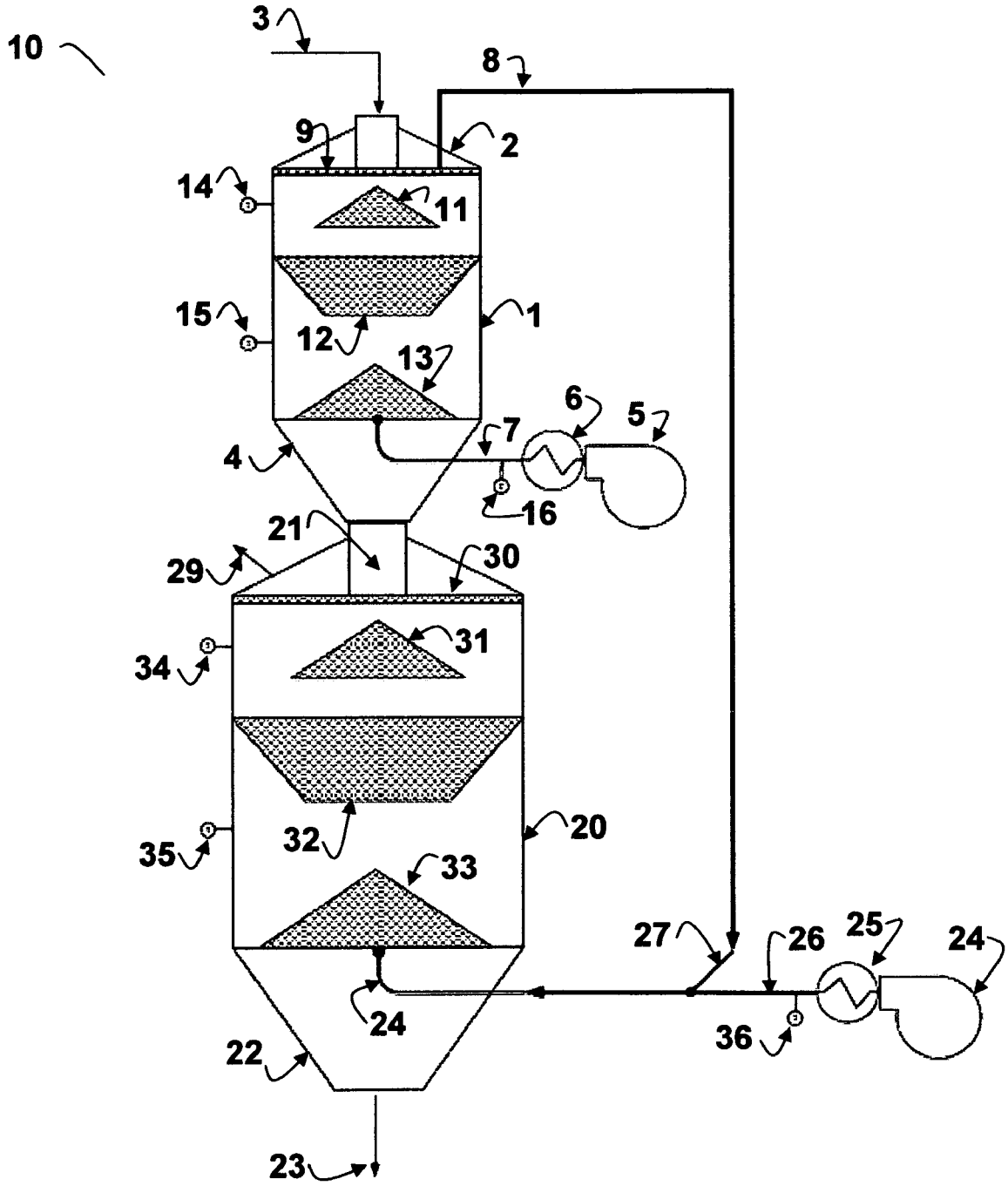
FIG. 1 is an elevation drawing of the two-stage static dryer.

The subject of the invention is a method and apparatus (10) for drying organic waste material into solid fuel. The method consists of two stages of drying. In the first stage, pelletized, wet organic material is heated for a short time interval in a high-temperature, vertical static dryer stage (1). The short residence time in the high temperature dryer rapidly dries the outer crust of the pellets, increasing the rigidity of the pellet and its ability to withstand shear stress and crush pressure in a downstream drying stage. In the second stage, pellets that have a dry exterior and moist interior are heated for a long time interval in a warm-temperature, vertical static dryer stage (2).

The process conditions in the first, high-temperature stage consist of:

(a) hot-air convective drying with heated air having a temperature between 150° F. (66° C.) and 350° F. (177° C.);
(b) short residence time of solid organic material between 30-300 seconds;
(c) ratio of volumetric airflow-to-solid organic material between 25-75 scfm (standard $ft^3$ )/$lb_{mass}$ (1.6-4.7 standard $m^3$/kg).
(d) air velocity of 300-600 ft/min (1.5-3.0 m/s) moving upward counter-currently to the downward flow of moist pellets The process conditions in the second, warm-temperature stage consist of:

(a) warm-air convective drying with heated air having a temperature between 90° F. (32° C.) and 150° F. (66° C.);
(b) long residence time of solid organic material between 2-12 hr (7,200-43,200 s);
(c) ratio of volumetric airflow-to-solid organic material between 40-100 scfm (standard $ft^3$ )/$lb_{mass}$ (2.5-6.3 standard $m^3$/kg).
(d) air velocity of 60-300 ft/min (0.3-1.5 m/s) moving upward counter-currently to the downward flow of partially dried pellets The upper, high temperature stage (1) of the apparatus consists of a top inlet (2) to receive wet, pelletized organic material (3) and a bottom outlet hopper (4) to discharge partially dried pellets. A forced draft fan (5) and air heater (6) whose thermal energy source may be from gas, steam, electric, or waste-heat provides hot air to the upper, high-temperature stage air to the inlet (7) in the bottom outlet hopper (4). Warm exhaust gas exits through the upper, high-temperature stage exhaust gas outlet (8). A filter screen (9) in the upper, high temperature stage prevents pellets from being entrained in the warm exhaust gas. An upper diffuser cone (11) and lower diffuser cone (13) distribute hot air evenly across the cross-sectional area of the upper, high-temperature stage. One or more pellet baffles (12) distribute moist pellets evenly across the cross-sectional area of the upper, high-temperature stage and prevent short-circuiting. A plurality of temperature indicators in the upper portion (14) and lower portion (15) of the upper, high-temperature stage provide monitoring information for operators. A temperature indicator and controller (16) on the discharge side of the forced draft fan (5) and air heater (6) controls hot air temperature.

The lower, warm-temperature stage (20) of the apparatus consists of a top inlet (21) to receive partially dried pellets from the upper, hot-temperature stage bottom hopper (4) and a bottom hopper and outlet (22) to discharge dried pellets (23). A forced draft fan (240) and air heater (25) whose thermal energy source may be from gas, steam, electric, or waste-heat provides warm air to one inlet branch (26) of a venturi mixing tee (27). The other inlet branch to the venturi mixing tee (27) is an extension of the upper, high-temperature stage exhaust gas outlet (8). The venturi tee (27) mixes the two warm gas streams. The discharge of the mixture of warm gases from the venturi tee (27) is connected to the lower, warm-temperature stage air inlet (28) in the bottom hopper and outlet (22). Cool, exhaust gas exits through the lower, warm-temperature stage exhaust gas outlet (29). A filter screen (30) in the lower, warm-temperature stage prevents pellets from being entrained in the cool exhaust gas. An upper diffuser cone (31) and lower diffuser cone (33) distribute hot air evenly across the cross-sectional area of the lower, warm-temperature stage. One or more pellet baffles (32) distribute partially dried pellets evenly across the cross-sectional area of the lower, warm-temperature stage and prevent short-circuiting. A plurality of temperature indicators in the upper portion (34) and lower portion (35) of the lower, warm-temperature stage provide monitoring information for operators. A temperature indicator and controller (36) on the discharge side of the forced draft fan (24) and air heater (25) controls the warm air temperature.

In a further preferred embodiment, the sensible heat in the exhaust gas from the upper, high temperature stage (8) is mixed with ambient air from the lower, warm-temperature stage forced draft fan (24) in a venturi tee mixer (27) without any additional thermal energy input from the lower, warm-temperature air heater (25). All of the input thermal energy input is added to the upper, high temperature stage to partially dry the outer crust of the pellets. The excess sensible heat of the air plus evaporated water vapor from the upper, high temperature stage is recirculated to heat the warm inlet air added to the lower, warm-temperature stage.

EXAMPLE

The following example for converting dewatered dairy waste into solid fuel provides representative operating conditions for the invention. Dairy waste that has been dewatered and pelletized has a moisture content of 58%. The dry solids in the dairy waste have a heat capacity of 0.70 BTU/$lb_{mass}$-° F. (2,900 J/kg-° C.). The heat capacity of the moist pellets composed of water and dry dairy waste solids is 0.87 BTU/$lb_{mass}$-° F. (3,600 J/kg-° C.). Ambient air is 75° F. (23.9° C.), and relative humidity is 75%. In order to dry the pelletized organic dairy waste to 10% moisture, 643 BTU/$lb_{mass}$ of pellets (1.5 MJ/kg) is added as thermal energy to the inlet air that is fed into the upper, hot-temperature dryer, resulting in the following operating conditions:

| British Engineering Units Pellets and Dryer | Moist Pelletized Organic Waste | Upper Hot-Air Dryer | Partially Dried Pellets | Lower Warm-Air Dryer | Dried Pellets |
|---|---|---|---|---|---|
| Pellets, % Moisture | 58% | | 48% | | 10% |
| Temperature, ° F. | 75 | 313 | 313 | 140 | 140 |
| Air, $lb_{mass}$/Pellet, $lb_{mass}$ | 3.85 | 2.80 | | 4.77 | |
| Air:Pellet Ratio - scfm/$lb_{mass}$ | 51.26 | 37.30 | | 63.47 | |
| Air Velocity (Actual), ft/min | | 500 | | 200 | |
| Residence Time | | 90 s | | 8 hr | |

| British Engineering Units Air | Ambient Air | Heated Air to Upper Hot-Air Dryer | Hot Exhaust Gas | Inlet Air to Warm-Air Dryer | Warm Exhaust Gas |
|---|---|---|---|---|---|
| Temperature, ° F. | 75 | 564 | 313 | 239 | 140 |
| Air, RH (%) | 58% | | | | 100% |
| Air, ft3/lbmass | 13.81 | | | | 18.86 |

| SI Units Pellets and Dryer | Moist Pelletized Organic Waste | Upper Hot-Air Dryer | Partially Dried Pellets | Lower Warm-Air Dryer | Dried Pellets |
|---|---|---|---|---|---|
| Pellets, % Moisture | 58% | | 48% | | 10% |
| Temperature, ° C. | 23.9 | 313 | 156 | 140 | 60 |
| Air, kg/Pellet, kg | 3.85 | 2.80 | | 4.77 | |
| Air, $m^3$/kg | 0.86 | | | 1.12 | 1.18 |
| Air Velocity (Actual), m/s | | 2.54 | | 1.01 | |
| Residence Time | | 90 s | | 28,800 s | |

-continued

| SI Units Air | Ambient Air | Heated Air to Upper Hot-Air Dryer | Hot Exhaust Gas | Inlet Air to Warm-Air Dryer | Warm Exhaust Gas |
|---|---|---|---|---|---|
| Temperature, ° C. | 23.9 | 564 | 156 | 239 | 60 |
| Air, RH (%) | 58% | | | | 100% |
| Air, m3/kg | 0.86 | | | | 1.18 |

The addition of 643 BTU/$lb_{mass}$ of pellets (1.5 MJ/kg) results in the removal of 0.533 $lb_{mass}$ of $H_2O$ per $lb_{mass}$ of pellets (0.533 kg/kg) for an overall thermal efficiency of 1,205 BTU/$lb_{mass}$ $H_2O$ removed (2.8 MJ/kg). This thermal efficiency is superior to fluid bed dryers, disk dryers, convection oven dryers, and rotary dryers, all of which have thermal removal efficiencies of 2,500-5,000 BTU/$lb_{mass}$ $H_2O$ removed (5.8-11.6 MJ/kg).

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

We claim:

1. A method for drying organic waste material comprising the steps of:

(a) hot-air convection drying, with wet solid organic material entering through the top inlet of the hot-air temperature unit and hot air entering through the bottom inlet of the hot-air temperature drying unit, said hot-air temperature drying unit further comprising the following operating conditions:

i) hot-air convective drying with heated air having a temperature between 150° F. (66° C.) and 350° F. (177° C.);

ii) short residence time of solid organic material between 30-300 seconds;

iii) ratio of volumetric airflow-to-solid organic material between 25-75 scf (standard $ft^3$)/$lb_{mass}$ (1.6-4.7 standard $m^3$/kg);

iv) air velocity of 300-600 ft/min (1.5-3.0 m/s) moving upward counter-currently to the downward flow of moist wet solid organic material;

(b) warm-air convection drying, with moist, partially dried solid organic material produced in the hot-air temperature drying unit entering at the top inlet to the warm-air temperature drying unit and warm air entering through the bottom inlet of the warm-air temperature drying unit, said warm-air temperature drying unit further comprising the following operating conditions:

i) warm-air convective drying with warm from a mixture of cooler ambient air and hotter air from the hot-air temperature unit exhaust gas, said mixture having a temperature between 90° F. (32° C.) and 150° F. (66° C.);

ii) long residence time of solid organic material between 2-12 hr (7,200-43,200 s);

iv) ratio of volumetric airflow-to-solid organic material between 40-100 scf (standard $ft^3$)/$lb_{mass}$ (2.5-6.3 standard $m^3$/kg);

iv) air velocity of 60-300 ft/min (0.3-1.5 m/s) moving upward counter-currently to the downward flow of partially dried solid organic material (c) gas recirculation of hot-air temperature unit exhaust gas that is mixed with ambient air to make warm inlet air for the warm-air temperature unit gas supply, said mixing of hot-air temperature unit exhaust gas with ambient air acting as means of increasing the thermal efficiency of the dryer.

2. A method for drying organic waste material as set forth in claim 1, wherein temperature controllers are used to control the thermal energy inputs to a) the hot inlet air in the hot-air temperature drying unit and b) the warm inlet air in the warm-air temperature drying unit.

3. A method for drying organic waste material as set forth in claim 1, wherein diffusion cones are used to distribute the volumetric flowrate of hot air evenly across the cross-sectional area of the hot-temperature drying unit and warm air evenly across the cross-sectional area of the warm-air temperature drying unit.

4. A method for drying organic waste material as set forth in claim 1, wherein pellet baffles are used to a) distribute the mass flow of wet solid organic material evenly across the cross-sectional area of the hot-air temperature drying unit and b) distribute the mass flow of partially dried solid organic material evenly across the warm-air temperature drying unit as material flows downward.

* * * * *